US006482273B1

(12) United States Patent
Nittel et al.

(10) Patent No.: US 6,482,273 B1
(45) Date of Patent: Nov. 19, 2002

(54) PREPARATION OF WORKPIECES FOR COLD FORMING

(75) Inventors: Klaus-Dieter Nittel, Frankfurt am Main (DE); Uwe Rau, Konigstein (DE)

(73) Assignee: Chemetall GmbH, Frankfurt am Main (DE)

( * ) Notice: Subject to any disclaimer, the term of this patent is extended or adjusted under 35 U.S.C. 154(b) by 0 days.

(21) Appl. No.: 09/787,043

(22) PCT Filed: Sep. 21, 1999

(86) PCT No.: PCT/EP99/06978

§ 371 (c)(1),
(2), (4) Date: Apr. 6, 2001

(87) PCT Pub. No.: WO00/18983

PCT Pub. Date: Apr. 6, 2000

(30) Foreign Application Priority Data

Sep. 28, 1998 (DE) ..... 198 44 391

(51) Int. Cl.[7] ..... C23C 22/00

(52) U.S. Cl. ..... 148/243; 148/252; 148/255; 148/259

(58) Field of Search ..... 148/243, 252, 148/255, 259

(56) References Cited

U.S. PATENT DOCUMENTS 3,795,548 A 3/1974 Hansen et al.
5,221,370 A * 6/1993 Jo et al. ..... 148/250
5,624,480 A 4/1997 Yoshitake et al.

FOREIGN PATENT DOCUMENTS

GB 665 993 A 2/1952
GB 731 882 A 6/1955
WO 96 09422 A 3/1996

OTHER PUBLICATIONS

ASM Handbook Committtee, "Metal Handbook, Ninth Edition, vol. 14: Forming and Forging", ASM International, 1988, pp. 299–312.*

* cited by examiner

*Primary Examiner*—Roy King
*Assistant Examiner*—Andrew L. Oltmans
(74) *Attorney, Agent, or Firm*—Fulbright & Jaworski L.L.P.

(57) ABSTRACT

The invention relates to a method for preparing workpieces suitable for phosphatizing for chipless cold forming by acid pickling, rinsing, drying and treatment with acid reaction lubricants containing phosphate ions. According to said method the workpieces are rinsed before drying with a solution which contains lactic acid, has a pH below 3 and preferably a temperature of between 60 and 80° C. Preferred embodiments of the invention consist of rinsing the workpieces with a solution which in addition contains phosphoric acid, has a lactic acid concentration of between 1 and 50 g/l and a weight ratio of lactic acid to phosphoric acid of between 1:9 and 9:1.

17 Claims, No Drawings

PREPARATION OF WORKPIECES FOR COLD FORMING

DESCRIPTION

The invention relates to a method for preparing phosphatizable workpieces for non-cutting cold-forming by acid pickling, rinsing, drying and treatment with acid reaction lubricants containing phosphate ions.

Acid reaction lubricants have an oily character and are distinguished by the fact that they contain, in addition to an organic lubricant, constituents which are able to form a conversion coating on the surface of the workpiece to be shaped (U.S. Pat. No. 3,525,651, U.S. Pat. No. 2,739,915, DE-B-21 02 295, EP-A-24 062, EP-A-25 236). The reaction lubricants which are by far the most important in practice contain phosphoric acid or zinc phosphate as the component which forms the conversion coating. Basically iron phosphate layers result in the presence of phosphoric acid during the treatment of the workpieces to be shaped, and conversion layers of zinc phosphate or zinc iron phosphate result when reaction lubricants containing zinc phosphate are used. The reaction lubricants, which are applied by dipping as a rule, create a strongly textured conversion coating on the surface of the workpiece, which ensures that a high degree of separation of workpiece and shaping tool takes place during the shaping, and, on the other hand, that there is a firm bonding of the organic lubricant on the surface of the workpiece.

The first treatment stages for the usual preparation of workpieces, in particular of pipes, comprise the bright annealing under inert gas at approximately 920° C., the subsequent pickling in hydrochloric acid or sulphuric acid and a, possibly multi-stage, rinsing with water.

The further treatment of the workpieces that usually follows before they are brought into contact with the reaction lubricant takes place by means of drying, possibly after renewed rinsing with an alkaline solution of an anticorrosive agent, such as borax, soda, nitrite, phosphate or sodium phosphate solution or mixtures of these. Drying is required because acid reaction lubricants react sensitively to a constant input of water.

Drying alone and also drying with prior rinsing with anticorrosive solutions are both disadvantageous with respect to the following treatment with the acid reaction lubricant. Drying alone is associated with rusting, which has a disadvantageous effect on the ability of the workpiece to be phosphatized since the required density and bonding strength of the phosphate layer which is formed are not ensured. Rinsing with a solution of alkaline anticorrosive agent that is carried out before drying is associated with a considerable introduction of salt into the acid reaction lubricant, which leads, on the one hand, to a considerable formation of sludge and, on the other hand, to a reduction in the operability because of a constant uptake of alkaline substances. Moreover, the layer formation is hindered, because acid reaction lubricants only unevenly pickle the alkaline workpiece surface.

The object of the invention is to provide a method for preparing phosphatizable workpieces for non-cutting cold-forming using acid reaction lubricants, which method does not have the above-mentioned disadvantages, in which method the workpieces are introduced in a rust-free state into the method stage of the treatment with the acid reaction lubricant, and in which method a perfect action of the acid reaction lubricant can be achieved without disadvantageously impairing the latter.

The object is achieved as a result of the fact that the method of the type mentioned in the introduction is developed, in accordance with the invention, in such a way that before the drying, the workpieces are rinsed with a solution which contains lactic acid and has a pH value of below 3.

For cold-forming, certain phosphatizable workpieces consist, in particular, of steel in the form of wire, pipe, profiles, round plates, etc, which are shaped by drawing, cold-extrusion, rolling, etc.

As a result of rinsing with the solution containing lactic acid, there results on the surface of the workpiece a layer which is formed from iron lactate and which can be recognised by a violet colour. This layer is not only rust-preventing, but has an activating effect on the layer formation during the treatment with the acid reaction lubricant.

Indeed, it is known from DE-B-2103086 to bring workpieces into contact with an aqueous solution the pH value of which is adjusted to 4 to 5.5 with lactic acid and which contains non-ionic surfactant, after an alkaline cleaning and before phosphatizing with subsequent electrophoretic painting at a temperature of below 60° C. However, in this text, there is a warning about treatment in such a way that lactate layers are formed, with reference to a possible impairment during the subsequent application of the phosphate layer. Because of the warning given in this document about a manner of working which results in the formation of a lactate layer, it was in no way to be expected that such an iron-lactate layer has a positive effect not only with respect to the corrosion protection but, in particular, with respect to the subsequent treatment with the acid reaction lubricant.

The adjustment of the pH value to below 3 can take place only with lactic acid. For cost reasons, however, it is advantageous additionally to use phosphoric acid and/or sulphuric acid to adjust the pH value. In this connection, in accordance with an advantageous development of the invention, phosphoric acid is preferred, because the subsequently applied reaction lubricant contains phosphate ions, and therefore the phosphate ions which are unavoidably introduced with the rinsing solution and which originate from the phosphoric acid are not of a foreign type.

Accordingly, when phosphoric acid and/or sulphuric acid are also used, a preferred embodiment of the invention provides rinsing the workpieces with a solution which contains 1 to 50 g/l of lactic acid. Although a lactic acid concentration outside the preferred range also leads to usable lactate layers, lactic acid concentrations in the preferred range produce lactate layers which are particularly advantageous with respect to corrosion prevention and activation of the lubricant-layer formation.

A further advantageous development of the invention consists in rinsing the workpieces with a solution which contains lactic acid and phosphoric acid in a weight ratio of 1:9 to 9:1. This development is particularly advantageous taking into account both the layer quality and the cost situation.

Rinsing with the solution containing lactic acid can take place with a solution temperature of 20 to 90° C.

In accordance with a further advantageous development of the invention, it is recommended to rinse the workpieces with a solution having a temperature of 60 to 80° C.

The invention is explained in greater detail with the aid of the following Example.

EXAMPLE

Pipes of the steel quality St34/2, which were bright-annealed under inert gas at approximately 920° C., were firstly pickled in a pickling solution at 50° C., containing 150 g/l of sulphuric acid 60 g/l of iron(II)

for a duration of 15 minutes, and were then rinsed in two stages with rinsing water applied in a cascaded manner.

Subsequently, the pipes, which were still wet, were rinsed in accordance with the invention with a solution which contained 10 g/l of lactic acid 20 g/l of phosphoric acid and had a pH value of <3. The temperature of the rinsing solution was 70° C. and the rinsing duration was 3 minutes. The pipes were then left to dry in the air and, with the remaining residual moisture, were treated in a conventional way with an acid reaction lubricant containing phosphate ions and were shaped by pipe drawing.

The pipes, which dried after rinsing, showed no rusting at all and had a lactate layer containing iron oxide and being of blue-violet appearance. The subsequent treatment with the reaction lubricant led to perfect lubricant layers. There was no impairment of the reaction lubricant of any kind.

For comparison, pipes of the same quality were subjected to the process described above, but instead of rinsing with the solution containing the lactic acid, a third rinsing was carried out with warm water.

After the pipes had dried, there was considerable rusting, which was responsible for uneven phosphate-layer formation in terms of density and bonding strength during the subsequent treatment with the same reaction lubricant.

What is claimed is:

1. A method for preparing steel workpieces comprising the steps of acid pickling steel workpieces;

rinsing the acid pickled steel workpieces;

contacting the rinsed steel workpieces with a solution which contains lactic acid and has a pH value of below 3;

drying the rinsed steel workpieces; and treating the dried steel workpieces with an acid reaction lubricant containing phosphate ions.

2. The method of claim 1, wherein said solution further comprises phosphoric acid.

3. The method of claim 1, wherein said solution comprises from 1 to 50 g/l of lactic acid.

4. The method of claim 2, wherein said solution comprises from 1 to 50 g/l of lactic acid.

5. The method according to claim 1, wherein said solution contains lactic acid and phosphoric acid in a weight ratio of 1:9 to 9:1.

6. The method according to claim 2, wherein said solution contains lactic acid and phosphoric acid in a weight ratio of 1:9 to 9:1.

7. The method according to claim 3, wherein said solution contains lactic acid and phosphoric acid in a weight ratio of 1:9 to 9:1.

8. The method according to claim 4, wherein said solution contains lactic acid and phosphoric acid in a weight ratio of 1:9 to 9:1.

9. The method of claim 1, wherein said solution has a temperature of 60 to 80° C.

10. The method of claim 2, wherein said solution has a temperature of 60 to 80° C.

11. The method of claim 3, wherein said solution has a temperature of 60 to 80° C.

12. The method of claim 4, wherein said solution has a temperature of 60 to 80° C.

13. The method of claim 5 wherein said solution has a temperature of 60 to 80° C.

14. The method of claim 1, wherein said solution has a temperature of 60 to 80° C.

15. The method of claim 7, wherein said solution has a temperature of 60 to 80° C.

16. The method of claim 8, wherein said solution has a temperature of 60 to 80° C.

17. A method for preventing rust formation on steel comprising contacting steel with a solution comprising lactic acid having a pH of below 3.

* * * * *